United States Patent [19]

Fischer

[11] 4,313,052

[45] Jan. 26, 1982

[54] COOKING UNIT

[76] Inventor: Karl Fischer, Am Gaensberg, 7519 Oberderdingen, Fed. Rep. of Germany

[21] Appl. No.: 26,640

[22] Filed: Apr. 3, 1979

[51] Int. Cl.[3] ..... H05B 1/02

[52] U.S. Cl. ..... 219/446; 219/486; 219/480; 219/485

[58] Field of Search ..... 219/446, 480, 486, 508, 219/448, 485; 307/39, 41

[56] References Cited

U.S. PATENT DOCUMENTS

| | | | |
|---|---|---|---|
| 1,946,886 | 2/1934 | Schramm, Jr. | 219/486 |
| 2,107,173 | 2/1938 | Bauer | 219/480 |
| 2,213,993 | 9/1940 | Meyers | 219/485 |
| 2,394,399 | 2/1946 | Newell | 219/508 |
| 2,483,866 | 10/1949 | Ziola | 219/485 |
| 2,932,715 | 4/1960 | Weeks | 219/485 |

FOREIGN PATENT DOCUMENTS

| | | | |
|---|---|---|---|
| 1029502 | 3/1958 | Fed. Rep. of Germany . | |
| 1265893 | 4/1968 | Fed. Rep. of Germany | 219/448 |
| 2150318 | 4/1972 | Fed. Rep. of Germany | 219/480 |
| 2058512 | 6/1972 | Fed. Rep. of Germany . | |
| 2414813 | 9/1975 | Fed. Rep. of Germany . | |

*Primary Examiner*—Gerald P. Tolin
*Assistant Examiner*—Bernard Roskoski
*Attorney, Agent, or Firm*—Steele, Gould & Fried

[57] ABSTRACT

A cooking unit comprises at least two electric cooking plates, for example four such plates. Each plate can have a pair of electrical heating resistances. Power is supplied to each cooking plate via a switching unit, comprising a thermostat. Each thermostat switches on and off and is so arranged that when part or all of the power to one cooking plate is switched off power is supplied to another cooking plate connected downstream thereof.

10 Claims, 6 Drawing Figures

COOKING UNIT

FIELD AND BACKGROUND OF THE INVENTION

Cooking units such as electric hobs, electric cookers, portable electric cookers or the like are usually provided with from two to four electric cooking plates each of which has an output of from 1000 to 2000 W so that food can be heated up relatively quickly on these cooking plates. A four-plate unit can therefore have a maximum output of 7 to 8 kW. This is often too much for a normal domestic mains supply, particularly if the mains voltage is only 120 volts. In addition, it is not possible to connect such a unit to a socket which is fused in the normal way. Cooking units have already been proposed which contain a power cooking plate with a high load and three cooking plates with a very low load which are intended for continued cooking. With this arrangement, the house-wife has to heat up each pan in succession on the one high power plate, e.g. bring the contents thereof to the boil, then transfer the pans to the three plates of lower power for continued cooking. This makes the cooking more difficult and demands particular attention.

SUMMARY OF THE INVENTION

The object of the invention is to provide a cooking unit with at least two electric cooking plates, at least one of which is rhythmically regulated or controlled by a switching device which manages with a small connected load and contains cooker plates which can be used fully.

According to the invention there is provided a cooker unit comprising at least two electric cooking plates, means for supplying electrical power to the plates, and a switching device for regulating or controlling the supply of power to at least one of the plates rhythmically, the switching device of at least one favoured cooking plate being such that when at least one portion of its power is switched off, at least one subsequent cooking plate is supplied with power.

A specific order of priority is thus determined (which can however be changed or eliminated by means of changeover switches) so that the subsequent electric cooking plates are supplied with current when the first cooking plate switches off the power at least partially owing to its control or regulating procedure. Since the initial cooking process takes place quickly when using a cooking plate having a high connected load and the power needed for continued cooking often does not exceed 10 to 15% of the connected load, sufficiently long periods are available in which the subsequent cooking plates are switched on. In particular, when the intervals or switching periods are very short, the cooking procedures on the subsequent cooking plates are rarely disturbed and the consumer will hardly notice the inevitable disconnection pauses of the subsequent cooking plates. This applies particularly when the cooking plates are arranged spatially in the cooking unit in their priority grading in such a way that the cooking plates which are used most on the basis of this arrangement are the first in the priority grading. A rhythmic mode of operation of the switching devices is important in the favoured electric cooking plates, but a subsequent cooking plate could also have a different type of regulation, for example a filter pulse circuit. The thermostat is preferably a so-called automatic controller which operates with a hydraulic sensor box which is arranged in the central zone of the cooking plate and is pressed on to the bottom of the cooking pot. In this arrangement, the electric cooking plate has two heating resistances and the controller has two associated contracts which switch off at successive temperature values. An additional cooking plate can be supplied completely or partially with current as soon as the first partial current is switched off.

In a particularly advantageous embodiment which not only keeps the connected load low but also saves energy, the switching device is a condition controller which responds to the steam produced in the cooking container. When this condition controller, of the type described in German Pat. No. 1,029,502, is allocated to the favoured electric cooking plate, it is even possible to prepare a meal consisting of several individual dishes on one cooking plate by stacking up cooking containers, the lower containers each heating the one above it, and using an additional subsequent cooking plate, for example for frying purposes.

DETAILED DESCRIPTION OF PREFERRED EMBODIMENTS

Figure 1:
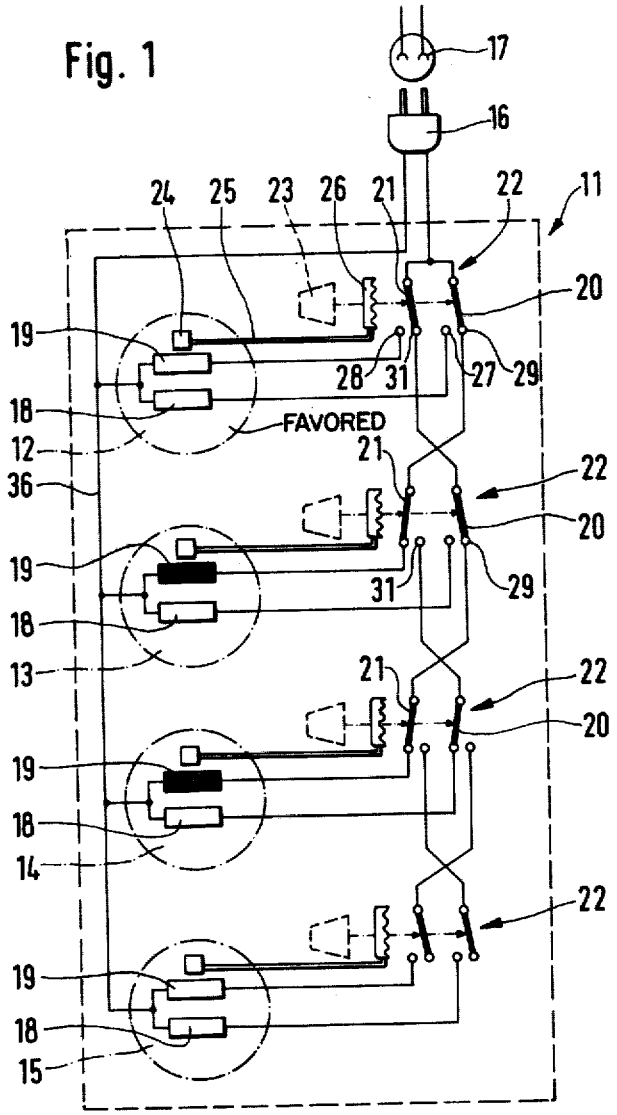
FIGS. 1 to 3 are schematic circuit diagrams of three cooking units.

The circuit illustrated in FIG. 1 comprises a cooking unit 11 having four electric cooking plates 12, 13, 14 and 15, which can be connected, in cascade, to the domestic mains at a socket 17 by means of a plug 16. The cooking unit can be an electric cooker, an electric hob or a portable electric cooker. Each electric cooking plate can be a conventional cooking plate made of cast material, each having two heating elements 18,19, which can be connected individually or together by two contact arms 20,21 or switching springs of a switching device 22. The switching device 22 is a thermostat which can be adjusted manually to the desired temperature by means of an adjusting head 23. Each thermostat is provided with a sensor box 24, which is spring-mounted in a conventional way (not shown) in the center of the cooking plate and can rest against the bottom of a cooking container in order to detect its temperature. It is generally connected to the internally arranged heating element 19. The sensor box 24 is filled with an expansion fluid and connected via a capillary tube 25 with an expansion box 26 which acts upon the contact arms 20,21 as a function of the temperature of the sensor box and the manual adjustment. The contact arms 20,21 are adjusted relative to each other in such a way that they switch in succession as the temperature rises, the contact arm 20 switching a few degrees before the contact arm 21. This substantially prevents the desired temperature from being exceeded.

The thermostat can be constructed in accordance with German Offenlegungsschrift No. 2,058,512 or German Pat. No. 2,414,813. The contact arms 20,21 are also electrically separated on the input side and can have two separate switching springs. The fixed contacts 27,28 of the switching device 22 leading to the heating elements 18,19 are each provided with a fixed transfer contact 29,31 which cooperates with the corresponding switching springs when the respective heating resistance is switched off.

The heating resistances of all cooking plates are connected via a return line 36 to one pole of the domestic mains and the contact arms 20,21 of the switching device for the first cooking plate 12 to the other pole. The transfer contact 29 is connected to the contact arm 21 of the next switching device and the transfer contact 31 is connected to the contact arm 21 of the next switching device, so that the transfer contact of the internal heating resistance of each cooking plate is allocated to the external heating resistance of another cooking plate. Owing to this cross-over circuit, the heating resistance which controls the temperature sensor 24 is charged at any time.

The cooking unit according to FIG. 1 operates in the following manner. The connecting plug 16 is connected to a socket whose fuse corresponds to the maximum power of the highest rated cooking plate, for example 2000 W. FIG. 1 shows a condition in which the cooking plates 12,13 and 14 are switched on by activating the adjusting button 23. With the cooking plate 12, the initial cooking process in which both heating resistances were switched on has already ended and the switching device has received an indication from the temperature sensor 24 that the adjusted temperature has been reached. An average power of up to only about 500 W is needed for continued cooking, and this is supplied by switching the heating resistance 19 on and off by means of contact arm 21 which in so doing switches over between the contacts 28 and 31. With the cooking plate 12, both contacts 27 and 28 are disconnected so that both contact arms 20,21 are connected to the transfer contacts 29,31 which are connected to the contact arms 20,21 of the subsequent cooking plate 13. The subsequent cooking plate 13 has also completed the initial cooking operation. Cooking plate 13 illustrates the condition in which the internal heating element 19 receives current (drawn in black), the heating up of which charges mainly the temperature sensor. The transfer contact 29 is open and the heating resistance 18 of the cooking plate 14 does not receive any current although, like heating element 19, it is switched on by the switching device 22 and the cooking plate has not yet reached the set temperature.

The condition illustrated does not last long because the cooking plate 13 is switched off again by the contact 21 after a very short period so that both heating resistances 18,19 of the cooking plate 14 then receive current.

Since, in the case of cooking plate 13, the heating resistance 18 is disconnected and the contact arm 20 is connected to the transfer contact 29, the contact arm 21 receives current from the cooking plate 14 and its heating resistance 18. The initial cooking operation is delayed somewhat by cooking plate 14 during the period when the cooking plate 13 receives its continued cooking power. However, when cooking plate 13 switches off shortly afterwards, cooking plate 14 receives full power. When cooking plate 12 is switched on, cooking plate 13 and the subsequent cooking plates act accordingly. The cooking plates 12 to 15 are therefore favoured over each other in the sequence of their connection. Although three cooking plates operate, the maximum connected output is not higher than for a single one. There is still sufficient switching time available for the last cooking plate owing to the small relative switching times.

Figure 2:
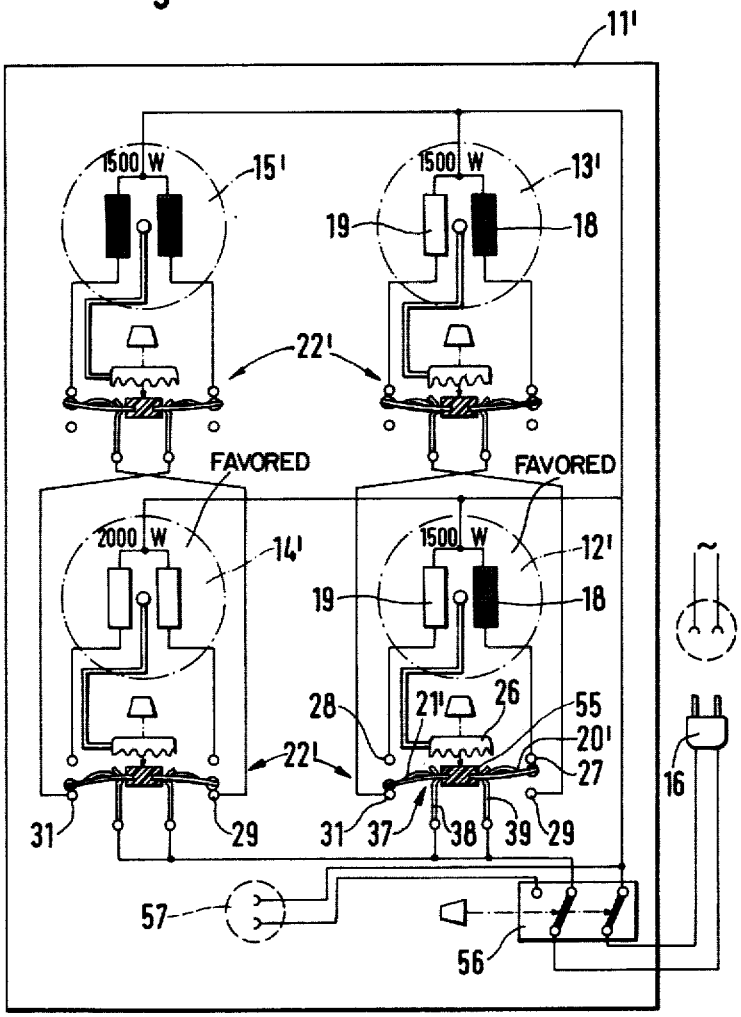

The cooking unit 11' in FIG. 2 also has four cooking plates, the cooking plates 12' and 15' having a smaller diameter and a power of 1500 W, and the remaining cooking plates 13' and 14' having a larger diameter and a power of 1500 and 2000 W respectively. The thermostats 22' differ from those in FIG. 1 only in that their structure is that of a simple snap switch. The snap switch has a movable catch spring 37 and consists of two contact halves 20' and 21', made of resilient material, from which are bent spring tongues which are supported in rigid supporting bearings 38,39 by means of which the current is supplied. The spring halves are inserted into a central insulating block 55, upon which the expansion box 26 acts. The contacts 27,28,29,31 cooperate with contacts at the end of the spring halves 20',21'. This double catch spring 37 is adjusted in such a way that the contact half 21' switches off at a lower temperature than the current half 20'.

Current is supplied from the domestic mains by a socket 16 via a manually activatable switch 56 which has two contact arms which switch on the cooking plates in one position, switch on a socket 57 for additional appliances, for example a mixer, in a second position, and separate the cooking plates from the two poles of the domestic mains in a third position. In FIG. 2, the thermostats 22' of the two favoured cooking plates 12' and 14' preferably arranged in the front portion of the cooking unit 11' are connected to one pole of the mains while the cooking plates 13',15' with their heating resistances are connected to the transfer contacts 29,31 of their thermostats. As in FIG. 1, the current supply lines 38,39 to the contact arms 20',21', are electrically connected together in the case of the favoured cooking plates 12',14', so that a normal double snap switch could be used here without electric insulation between the two contact halves 20',21' while although the electric separation of the two contact arms from each other is important in the subsequent cooking plates 13',15', the transfer contacts could be dispensed with.

It is assumed in the condition illustrated in FIG. 2 that all cooking plates are switched on. The cooking plates 12',14' have reached their set temperature range. The continued cooking power 18' is just supplied to cooking plate 12', while cooking plate 14' has switched off completely. Accordingly, only one heating element 18 is switched on in the cooking plate 13' connected downstream of cooking plate 12', while both heating elements are switched on at cooking plate 15' because it is still heating up.

Although the cooking unit 11' has two completely usable favoured cooking plates 12',14' and the two subsequent plates can be used almost always completely outside the heating up time of the favoured cooking plates, the connected load is only 3500 W, say 16 Amperes at 220 V, providing that the heating resistances 18,19 are the same. The serviceability is therefore increased by dividing into two branches 12',13' and 14',15'. The switch 56 ensures bipolar disconnection and ensures that the socket 57 is only used when the cooking plates are not switched on. It could also be connected to the free transfer contacts of the cooking plates 13', 15', and thus be included in the priority circuit.

Figure 3:
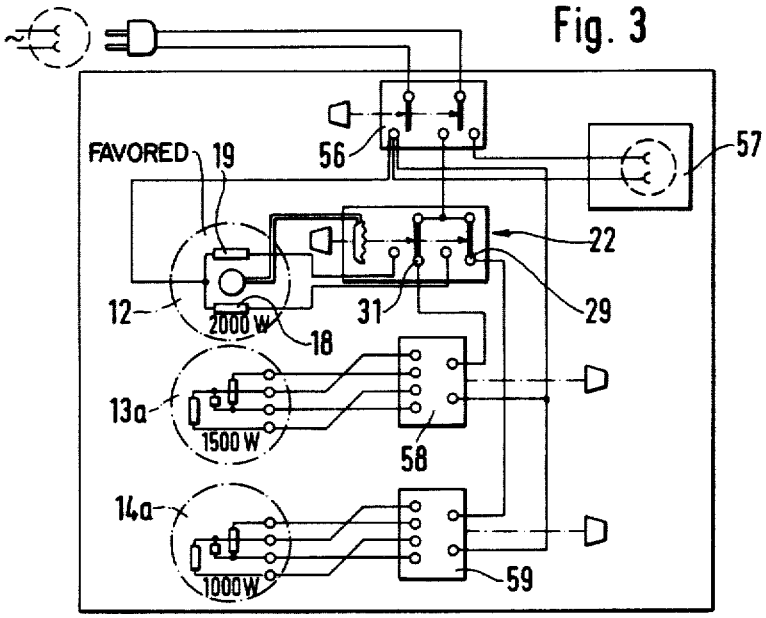

FIG. 3 shows a cooking unit with a manual switch 56, a socket 57 as in FIG. 2 and a cooking plate 12 as well as a thermostat 22 as in FIG. 1. In this arrangement, a manual filter pulse switch 58 is connected to the first transfer contact 31 used and a filter pulse switch 59 to the transfer contact 29, and these switches each control three heating elements of cooking plates 13a, 14a via switching springs activated by cams. In this embodiment, therefore, the cooking plate 13a is put into full operation once the heating resistance 19 of the cooking plate 12 has been switched off and the cooking plate 14a is put into operation completely once the heating resistance 18 has also been switched off. The maximum connected power is 2500 W, although the combined wattage of the cooking plates is 4500 W.

Figure 4:
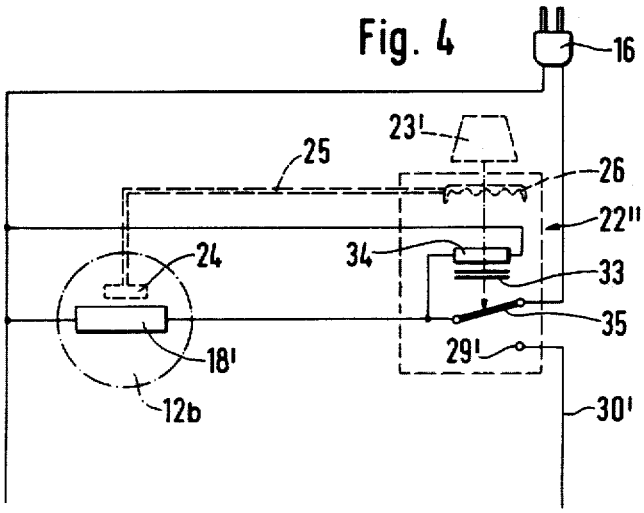
FIG. 4 shows a detail of a modified form of unit.

FIG. 4 shows a modified switching device 22'' whose cooking plate 12b has only one heating element 18' for the entire output. The expansion socket 26 acts on a bimetallic member 33 which is heated by a low power control heating resistance 34 and is connected in parallel to the heating resistance 18'. This heating resistance 18' and the control heating resistance 34 are controlled by a snap switch 35 which supplies the two heating resistances in its "on" position as illustrated, whereas, in the "off" position, it is connected to the transfer contact 29' which is itself connected to the feed line 30' to the switching device of the next cooking plate which is completely switched on in this way.

This embodiment according to FIG. 4 operates in the following manner. The thermostat of this embodiment is rhythmic in operation and can be adjusted manually to a specific temperature value by the adjusting knob 23'. The bimetallic member 33 which is heated as the cooking plate is heated produces a rhythm, i.e. successive switching on and off of the single heating elements 18', the relative switching on period changing in accordance with the temperature adjustment (knob 23') and the actual temperature on the cooking container. This relative switching on period will diminish from about 100% during the initial cooking phase to about 10 to 20% during the continued cooking phase. The full power is available for the subsequent cooking plates in the pauses i.e. during the continued cooking phase between 80 and 90% of the time.

If the thermostat 24, 25, 26 illustrated in broken lines is omitted, a step-less rhythmic power control device is formed which supplies the subsequent cooking plate in its disconnected periods.

Figure 5:
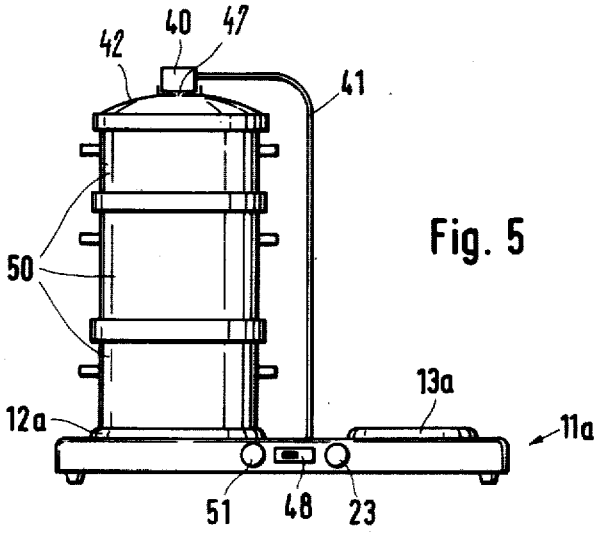
FIG. 5 shows the side view of a cooking unit.
Figure 6:
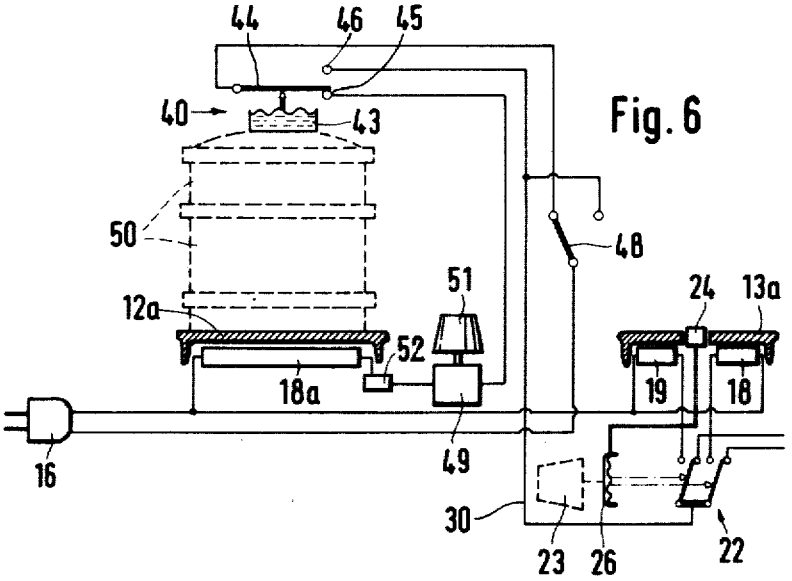
FIG. 6 shows the circuit diagram of the cooking unit according to FIG. 4.

FIGS. 5 and 6 show a cooking unit 11a which is designed as a portable unit and possess two cooking plates 12a and 13a. The cooking plate 12a is provided with a condition controller 40 which is connected to the cooking unit 11a via a flexible line 41 and is suitable for being placed on a lid 42 of a cooking pot 50 which has an opening 47 for the passage of steam.

Three superimposed cooking pots 50 which are designed so that they fit on to each other with the two lower cooking pots each heating the one above it, are placed on to the cooking plate 12a. Several different dishes can be cooked in different cooking containers using a single cooking plate by means of this "tower" cooking.

The steam issuing out of the upper cooking pot lid 42 shows that all cooking pots have reached the cooking temperature. The steam acts on a barometric cell 43 which is filled with a liquid having a boiling point which is somewhat lower than the boiling point of water. The issuing steam therefore causes rapid evaporation in the cell 43 so that a switch 44 in the condition controller 40 is activated via a membrane, this switch being designed as a snap switch and switching over between a contact 45 and a contact 46.

A change-over switch 48 is provided to allow the condition controller 40 and therefore the cooking plate 12a to be switched off completely. In the illustrated switch position of the change-over switch 48, the electric cooking plate 12a, which has only one heating resistance 18a, is switched on via the switch 44 and a control switch 49 as well as a temperature protection switch 52. The control switch 49 can be either a simple on/off switch, a 7-time switch or even a stepless power control device. The temperature protection switch protects the cooking plate and cooking pots if the condition controller is accidentally not put on or if food has been put on without water.

The cooking plate 13a has a switching device 22 of the type shown in FIG. 1. The common line 30 from the switching device 22 is connected to the transfer contact 46 of the condition controller 40 as well as to a contact of the change-over switch 48. Additional cooking plates, sockets or appliances can be connected in series with the cooking plate 13.

The cooking unit 11a operates in the following manner. In order to prepare a complete meal with, for example, four different dishes, three dishes to be cooked are poured into the three cooking pots 50 which are placed on top of each other and closed with the lid 42. The cooking plate 12a is switched on via the adjusting knob 51 of the control switch 49 once the cooking pots 50 have been placed on the cooking plate 12a and the condition controller 40 has been placed on to the lid 42. The heating resistance 18' heats the three cooking pots with its total output until the cooking temperature prevails in the uppermost cooking pot 50, steam issuing through the opening 47 heats the barometric cell 43 and switches the switch 44 from the contact 45 over to the contact 46. The cooking plate 12a is thus switched off and the cooking plate 13a, on which a further boiling or frying operating can be performed is supplied via the line 30. After initial cooking, the continued cooking power is very low so that the cooking plate 13a is ready for use over 80% of the time. The condition controller 40 functions in cooperation with the cooking plate 12a with a small time lag so that it switches off again seconds after it has been switched on again. Such a short power surge is sufficient to allow steam to be evolved again. It is therefore actually controlled to the "cook" condition and not to the associated temperature which can only be detected imprecisely. The short interuptions of power are hardly noticeable in the cooking plate 13a. This embodiment allows a meal with four or more different dishes to be cooked at the same time using one two-plate stove which has the connected load of only one cooking plate.

The change-over switch 48 ensures that the priority which the cooking plate 12a normally has over the cooking plate 13a is given to the latter and therefore that the cooking plate 12a is disconnected. It is also possible to change only the priority. Instead of using the condition controller 40 which is connected to the cooking unit 11a via a flexible line 41, it is also possible to use a condition controller which transmits its on and off signals to the cooking unit without the use of wires (see German Auslegeschrift No. 2161371).

Numerous variations of the embodiments described and illustrated are possible within the scope of the invention. Although the cast cooking plates described are particularly advantageous in conjunction with the invention owing to their temperature-compensating properties, other cooking points can also be used, for example, each electric cooking plate can be formed by a heating unit beneath a glass ceramic plate, or the electric cooking plates can be formed by tubular heating bodies. It is also possible to connect one or more independent cooking plates in parallel with the cooking plates which are connected in cascade.

What is claimed is:

1. A cooking unit comprising:

at least one cascade cooking unit, said cascade cooking unit including a favored cooking plate having at least two electric heating elements;

at least one additional cooking plate having at least one heating element;

a thermal sensor associated with said favored plate and responsive to at least one of said heating elements of said favored cooking plate; and, thermostatic switching means responsive to said thermal sensor, said switching means operating in a first mode to supply power solely to said elements of said favored plate, and in response to a predetermined temperature sensed by said sensor operating in a second mode to supply power to only one of said elements of said favored plate and to supply power to at least one of said elements of said at least one additional plate through a series connection.

2. A cooking unit according to claim 1, wherein the thermostatic switching means operates in a third mode whereby power is supplied to said at least one additional plate and no power is supplied to said favored plate.

3. A cooking unit according to claim 1, wherein each of said at least one additional cooking units has a thermal sensor and a thermostatic switching means, each of said thermal switching means operating in said two modes.

4. A cooking unit according to claim 1, wherein the thermostatic switching means has at least one transfer contact for switching power between the favored cooking plate and said at least one cooking plate during the second mode.

5. A cooking unit according to claim 3, wherein each of the thermostatic switching means has at least two switching contacts which switch at successive temperatures, each of the switching contacts switching one of the heating elements, at least that one of the switching contacts responding to the highest temperature having a transfer contact connected to a subsequent cooking plate.

6. A cooking unit according to claim 5, wherein all of the cooking plates have at least two heating elements, each sensor being heated most directly by only one of the heating elements of its cooking plate defining a most effective heating element, the transfer contact connecting the switching contact of the least effective heating element of the favored cooking plate to the most effective heating element of the subsequent cooking plate.

7. A cooking unit according to claim 6, wherein each of the thermostatic switching means has a snap switch with a catch spring, said contacts cooperating with a catch spring contact at each end.

8. A cooking unit according to claim 1, wherein the thermostatic switching means has short switching periods.

9. A cooking unit according to claim 3, comprising a plurality of said cascade cooking units interconnected in series and/or parallel- inserted therefore.

10. A cooking unit according to claim 1, comprising a manually activatable switch, having a switching position in which all of the cooking plates are switched off and in which a connection to another electric cooking appliance is simultaneously provided.

* * * * *